US006481361B1

(12) United States Patent
Schindler et al.

(10) Patent No.: US 6,481,361 B1
(45) Date of Patent: Nov. 19, 2002

(54) COAL BALANCING DAMPER

(75) Inventors: Edmund S. Schindler, Fairfield; Robert W. Monro, Jr., Darien, both of CT (US)

(73) Assignee: RJM Corporation, Norwalk, CT (US)

( * ) Notice: Subject to any disclaimer, the term of this patent is extended or adjusted under 35 U.S.C. 154(b) by 0 days.

(21) Appl. No.: 09/657,723

(22) Filed: Sep. 8, 2000

Related U.S. Application Data

(60) Provisional application No. 60/153,152, filed on Sep. 9, 1999.

(51) Int. Cl.[7] ..... F23B 7/00; F23L 1/00; F23L 13/00; F23K 3/00

(52) U.S. Cl. ..... 110/341; 110/163; 110/101 R; 110/101 C; 110/101 CF

(58) Field of Search ..... 110/341, 342, 110/343, 163, 265, 101 R, 104 R, 106, 104 A, 101 C, 101 CF; 138/39, 43, 46; 251/8, 212

(56) References Cited

U.S. PATENT DOCUMENTS

| | | | | | |
|---|---|---|---|---|---|
| 2,546,714 | A | * | 3/1951 | Bataile | 110/163 |
| 3,312,159 | A | * | 4/1967 | Shepherd | 98/1 |
| 3,934,851 | A | * | 1/1976 | Illing | 251/248 |
| 4,046,318 | A | * | 9/1977 | Ripley | 236/1 G |
| 4,390,123 | A | * | 6/1983 | McCabe | 236/16 |
| 4,425,855 | A | * | 1/1984 | Chadshay | 110/263 |
| 4,459,922 | A | | 7/1984 | Chadshay | |
| 5,277,397 | A | * | 1/1994 | Tartagliano | 251/61 |
| 5,685,240 | A | | 11/1997 | Briggs, Jr. et al. | |
| 5,713,291 | A | * | 2/1998 | Mull | 110/264 |
| 6,186,079 | B1 | * | 2/2001 | Wark et al. | 110/104 R |

FOREIGN PATENT DOCUMENTS

| | | | |
|---|---|---|---|
| GB | 2132318 A | * | 7/1984 |
| JP | 1054544 | * | 2/1998 |

* cited by examiner

*Primary Examiner*—Ira S. Lazarus
*Assistant Examiner*—K. B. Rinehart
(74) *Attorney, Agent, or Firm*—St. Onge Steward Johnston & Reens, LLC

(57) ABSTRACT

A damper assembly for adjusting a full flow of the air-entrained coal traversing at least one annular conduit along a flow path, wherein the one conduit has a peripheral wall defining the entire cross-sectional area of the conduit, the damper assembly includes an elongated blade, which has its length substantially greater than its width and which is rotatably mounted to the conduit to adjust the flow from no change to approximately 75% of the full flow.

15 Claims, 7 Drawing Sheets

COAL BALANCING DAMPER

This application is based on a Provisional Patent Application 60/153,152 filed Sep. 9, 1999.

FIELD OF THE INVENTION

The present invention relates to a damper assembly for controlling the flow in coal pipes supplying burners in furnaces and boilers. Particularly, the invention relates to a new and improved boiler blade which is sized to effectively block only a part of the entire cross-section of a coal pipe.

BACKGROUND OF THE INVENTION

A pulverized coal-burning boiler has one or more pulverizers which are used to grind lumps of coal into particulates with a certain desired size distribution. Feed pipes ranging from 8"–24" in diameter typically transport the airborne pulverized coal (PC) to each burner in feed pipes ranging from 8"–24" in diameter. The number of burners fed by one pulverizer can be anywhere from 2–13 which are supplied by as many pipes carrying the pulverized coal.

In order to attain thermal efficiency and to maintain close control of stock emission in a multi-burner boiler system, it is essential to maintain a good balance among all the burners. The flow of pulverized coal is the single most important process variable that needs to be controlled to achieve balanced operation among several burners. The imbalance needs to be corrected to insure efficient combustion. To balance the burners, it is necessary to measure and control the coal flow rate and the primary and secondary airflow rates to each burner. Balanced burner operation requires that the mass flow rate of both air and pulverized coal be the same among all the pipes leading to the burner within certain operating limits.

Common industry practice is to install a plate controlling the full area of the pipe or conduit when only a part of this area needs to be blocked to balance flow to multiple burners.

U.S. Pat. No. 5,685,240 to Briggs discloses a pulverized coal flow control system including a frame sealingly secured to an outside surface of the coal pipe around a window opening formed on one side of the pipe. A rotatable damper plate inserted through the opening has a cross-section comparable with a cross-section of the coal pipe and is provided with an orifice opening at its center. The plate is adapted to rotate to vary the flow cross-section of the orifice opening for controlling the flow of coal and primary air to a burner.

The installation of such plate can be quite costly for two reasons. First, the window opening formed in the side of the pipe should be large enough to receive the damper plate, and second, the manufacture of the central orifice requires a specifically designed piece of equipment. Further, because the outer diameter of the damper plate is only insubstantially less than an inner diameter of the pipe, when the plate is tilted, the flow is directed against an inner surface of the pipe. This, in turn, may cause rapid deterioration of the pipe both because of the high velocity of the flow impinging upon the inner surface and high temperatures.

U.S. Pat. No. 4,459,922 to Chadshay discloses a plurality of plate segments pivotally mounted in a bracket, which is fastened between two conduit sections through which air-entrained pulverized coal flows, the segments being pivoted by an operator from external the conduit. Each of the plate segments has a complex arcuate cross-section and is pivoted eccentrically between the minimum and maximum of restriction to the coal/air flow through a conduit.

The complexity of this system makes it to be rather expensive. Furthermore, because of the numerous tilting positions each segment can direct a fraction of the flow against the inner surface of the conduit which may damage its inner surface for the reasons discussed above.

Accordingly, there is a need for a simple, cost-efficient damper assembly which does not require complicated installation. A damper assembly including a damper plate blocking a percentage of the entire cross-section of a coal pipe is desirable, as is a damper assembly easily controllable to vary a percentage of the blocked cross-section of the coal pipe.

SUMMARY OF THE INVENTION

The present invention solves the problems associated with the prior art by providing an a damper assembly having at least one generally flat damper plate having a length, which is substantially less than an inner diameter of a conduit, and a width, which is substantially less than this inner diameter. Rotating of the blade, manufactured in accordance with the invention, can adjust the flow from no change to about 75% of full flow. The dimensions of the damper blade allow insertion of the assembly through a small opening in a wall of the conduit. The opening's diameter can be substantially the same as the width of the plate. In contrast, the known prior art assemblies typically necessitate formation of a large opening receiving damper plates designed to control the full area of the conduit.

In accordance with another aspect of the invention, the shape of the damper plate can be modified to effectively block a percentage of the full area greater than a percentage blocked by a flat damper blade. Particularly, an angle can be added to at least one of opposite blade sides facing the flow. Preferably, both opposite sides are angled to even further increase the area of the conduit that can be blocked, without however enlarging the opening.

In accordance with another aspect of the invention, a damper assembly includes a plurality of damper blades angularly displaceable relative to one another to effectively block a larger cross-section of the conduit when they are spaced from one another. One of the embodiments allowing the angular displacement of the blades includes a pin traversing proximal ends of these blades. Still another embodiment can be implemented by pivotally attaching the central regions of the blades. In accordance with the main concept of the invention, the blades have substantially a uniform width which is small relative to the inner diameter of the conduit. As a consequence, an opening provided in the wall of the conduit is dimensioned substantially equal to the cumulative thickness of the blades in a rest position, wherein the blades are aligned.

Displacement of the damper blades can be utilized by employing a variety of methods. Thus, for example, actuating a screw that has its distal end urging against a cam surface which is formed either on a proximal end of the damper blade or in its central region can move the blade relative to the other blades in a desirable angular position. In order to displace this blade in its initial position, the assembly can be pulled back from the conduit through a sleeve attached to the conduit's wall and having an inner diameter which is insubstantially greater than the width of the blade. Alternatively, another screw can be actuated to impart the motion upon the cam surface of the displaced blade in a direction towards the blade's initial position. The screws can be actuated manually, electrically or pneumatically.

Accordingly, an object of the present invention is to provide a damper assembly for controlling the flow of fluid transported solid particles.

A further object of the present invention is to provide a damper assembly which is simple in design, rugged in construction, and economical to manufacture.

Another object of the present invention is directed to a damper assembly having a single damper blade effectively blocking a percentage of the full are of a conduit which is traversed by the flow of fluid transported solid articles.

Yet another object of the invention is to provide a damper assembly including a multiplicity of blades which are angularly displaceable relative to one another to vary a percentage of the full area of the conduit traversed by the flow.

Still another object of the invention is to provide a damper assembly with an angled damper blade to effectively block a large area of the conduit.

For a better understanding of the invention, and the operating advantages attained by its use, reference is made to the accompanying drawings and descriptive matter in which a preferred embodiment of the invention is illustrated.

DETAILED DESCRIPTION OF THE DRAWINGS

Referring to FIGS. 1–6, a damper assembly 10 is utilized for controlling the primary air flow carrying the pulverized coal along a coal/air pipe 12 which supplies the air-entrained coal flow 14 to a burner, not shown here and well known from U.S. Pat. No. 5,685,240 to Briggs that has been discussed hereinabove.

Figure 1:
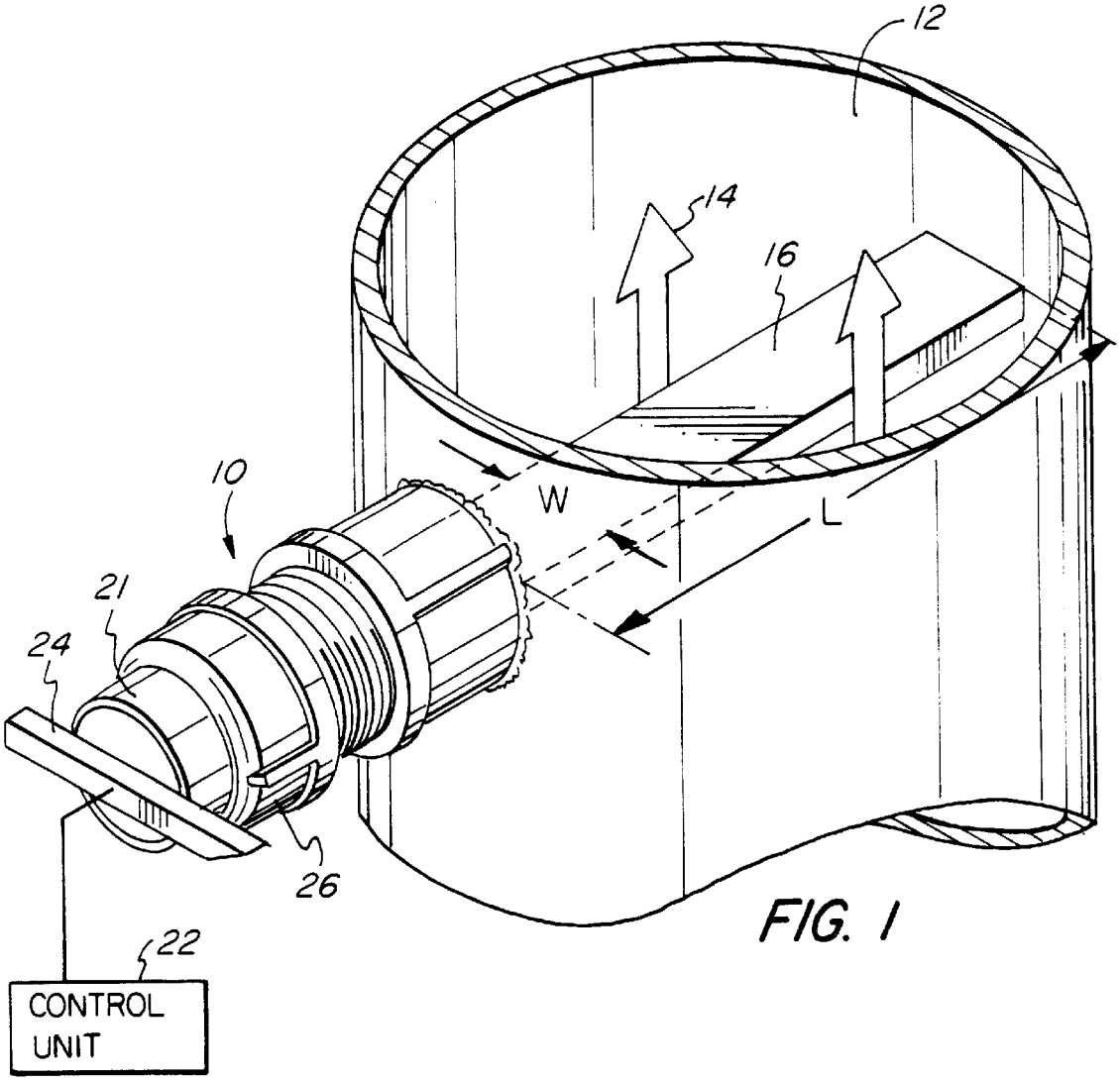
FIG. 1 is a perspective view of a damper assembly in accordance with one embodiment of the invention.
Figure 2:
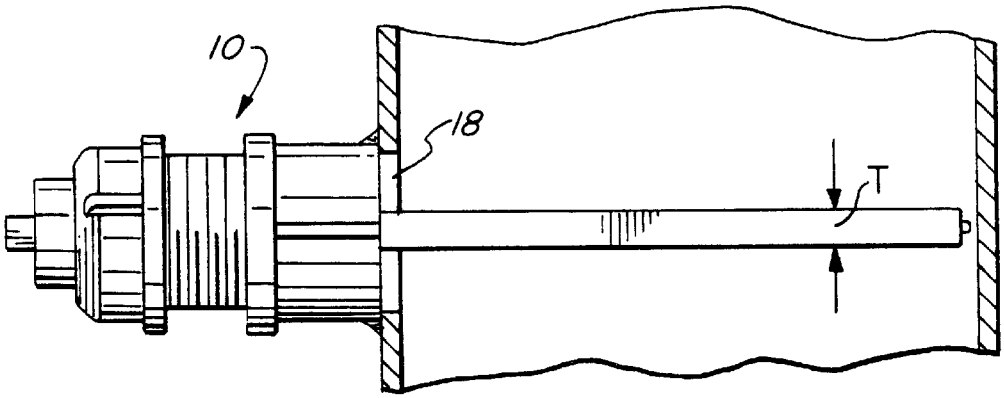
FIG. 2 is a sectional top view of the damper assembly of FIG. 1.

The basic inventive concept of the present invention includes a blade 16 effectively blocking only a part of the entire cross-section of the pipe 12. The installation of the blade 16 having its width W which is substantially less than its length L is easy because an opening 18 provided in the pipe 12 and receiving the blade is practically equal to the width of the blade. In contrast to many existing dampers, which rely on controlling the full cross-sectional area of a conduit, the present blade effectively controls from 15 to 40% of the area in a blocking position of the blade, as shown in FIG. 1. In general, the blade's dimensions are a function of the pipe's diameter; for example, a damper for a 12" pipe would have a 2" by 12" blade attached to a 2" diameter rod 20 (FIG. 3), which is received in a 2" diameter opening 18. The blade has an insignificant thickness T, as shown in FIG. 2, which illustrates the blade in a position, wherein the blade extends in a plane parallel to the flow 14, which practically passes through the pipe unchanged. The position of FIG. 2 is obtained upon rotating the blade 16 from its initial position by an actuator monitored by a control unit 22. An external torque is applied to a lever 24 of a cap 26 which is attached to the blade 16 for synchronous rotatable motion, as will be explained hereinbelow. The actuator may be electrically or pneumatically powered and controllably rotates the blade at a preset angle so it can change up to 75% of the full possible flow 14.

Figures 3, 4, 5, 6:
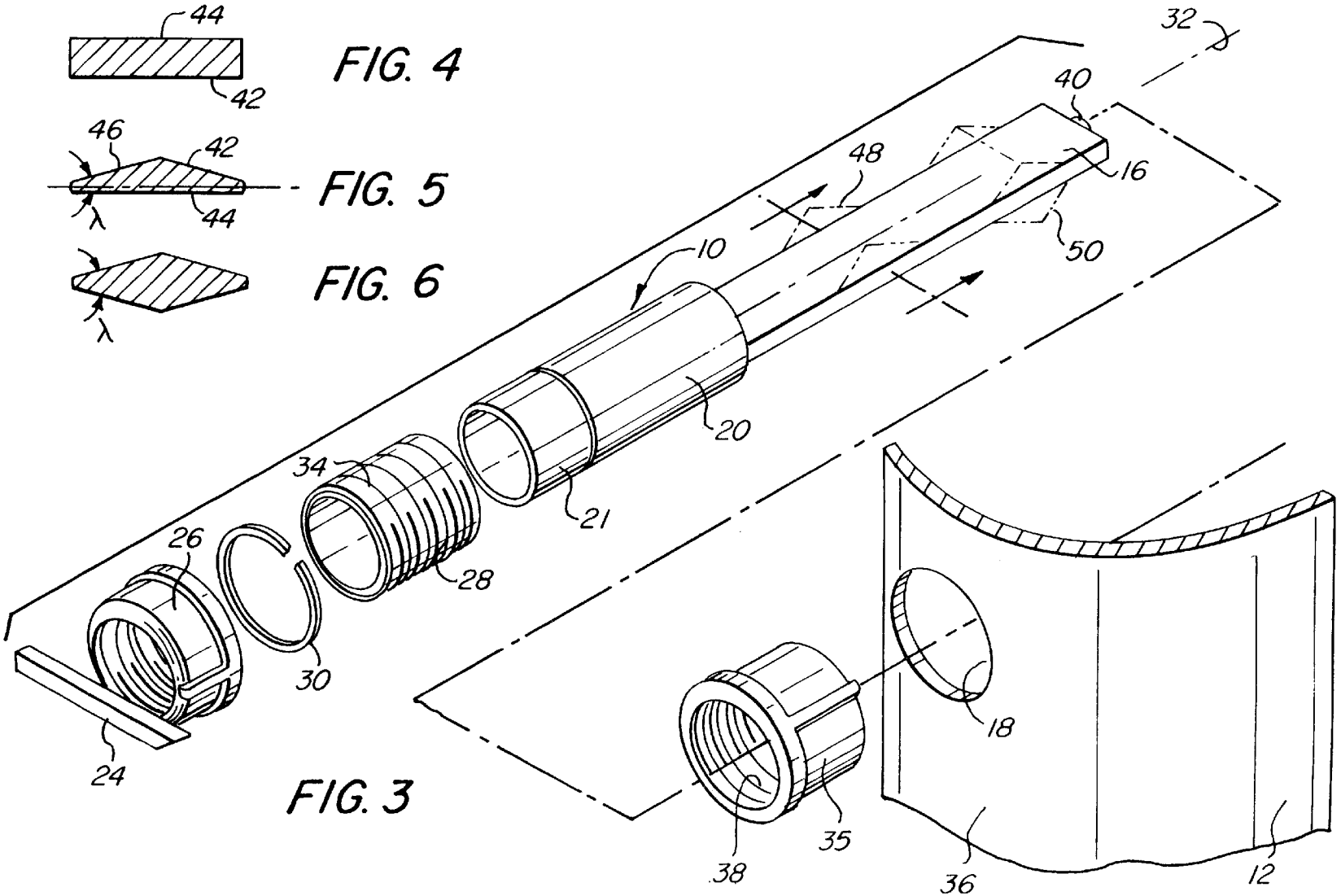
FIG. 3 is an exploded perspective view of the damper assembly shown in FIG. 1.
FIGS. 4–6 are rectangular, triangular and diamond cross-sections of first, second and third modifications, respectively, of a damper blade of the damper assembly shown in FIG. 1.
Figure 13:
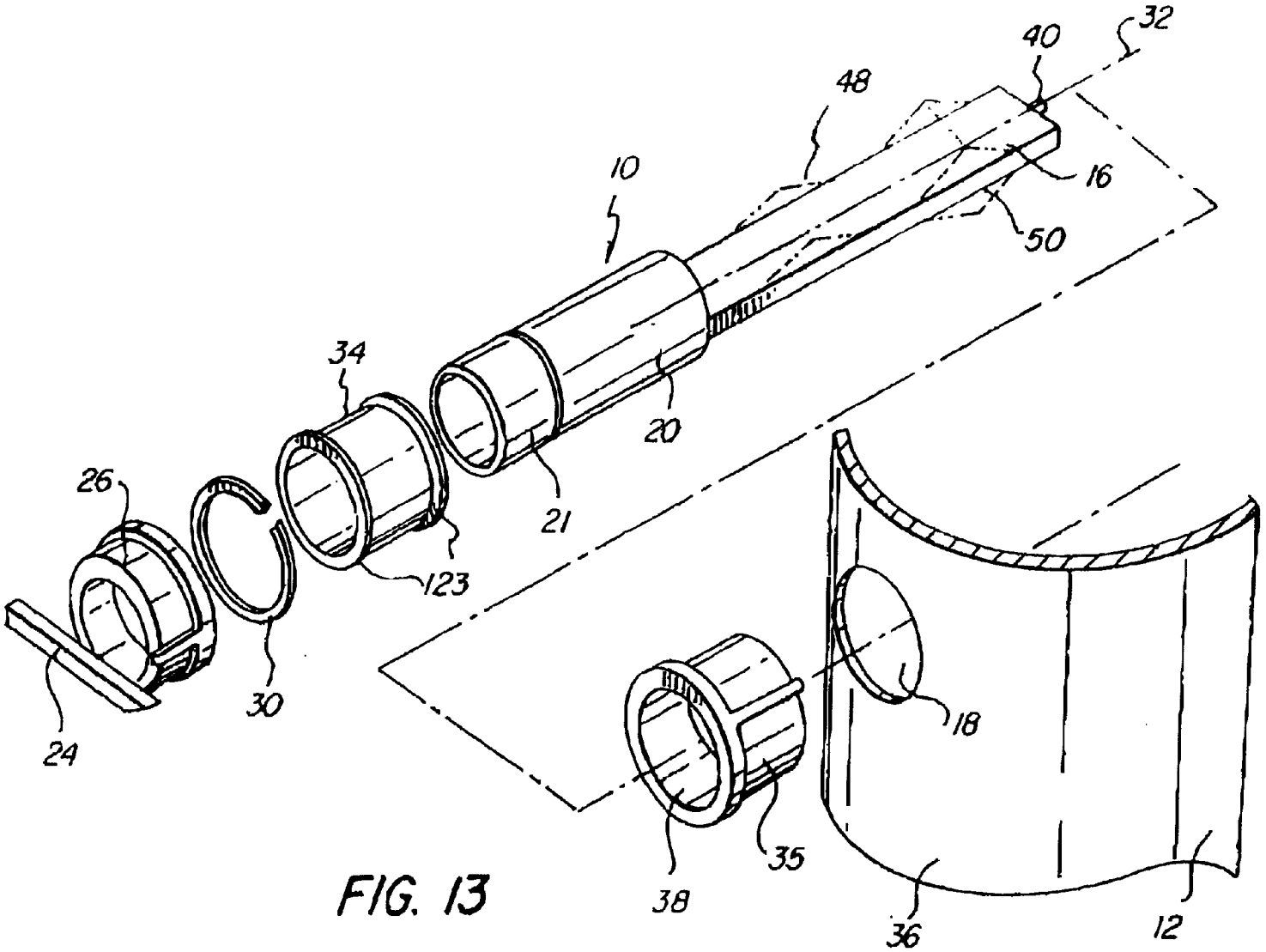
FIG. 13 is an exploded perspective view of an alternative embodiment of the damper assembly shown in FIG. 1.

Referring to FIG. 3, the damper assembly 10 besides the above-described blade 16 which is attached to a distal end of the rod 20, has a nipple 28 rotationally mounted on the rod 20 in a manner that allows relatively a displacement of these two parts. The cap 26 is provided with a snap ring 30 mounted between the cap and the distal end to arrest relative displacement of these parts along an axis of rotation 32. The cap is also threadedly engaged by an external thread 34 formed along the entire length of the nipple, which, in turn, is immovably attached to the rod 20 so as to enable synchronous rotational motion of the entire assembly upon applying the torque to the lever 24 that is attached immovably to the cap. Completing the damper assembly is a mounting flange or sleeve mounted to a peripheral wall 36 of the pipe 12 such that is surrounds the opening 18. The mounting flange receives a distal end of the nipple and has an internal thread 38 mating with the thread 34 of the nipple 28. Thus, after the blade 16 is fully inserted through the opening 18 the assembly is simply threadedly mounted to the mounting sleeve which thus allows the damper assembly 10 to rotate along the axis of rotation 32. Alternatively, as shown in FIG. 13, if the contacting surfaces of the nipple, cap and sleeve all have smooth surfaces, than O-ring seals or compression seals 123 can be provided between these surfaces to allow rotation upon applying an external torque. The fully inserted position is registered when the rod is inserted in the opening 18 and the blade terminates immediately adjacent to a region of the pipe located diametrically opposite to the opening 18. In order to prevent contact between a distal end of the blade and an inner surface of the peripheral wall 36, a pin 40 is welded to the distal end.

In accordance with one aspect of the invention, the blade 16 can have different cross-sections varying from a rectangular one, which is defined between upstream and downstream flat faces 42, 44, respectively. In order to effectively block a large cross-section of the pipe, the upstream face 42 can be modified to have a triangular shape, as shown in FIG. 5. The triangular shape improves aerodynamics of the flow by creating a vacuum downstream from the downstream face 44 and helps prevent the blade from an excessive wear. An angle $\lambda$ formed between each of opposite flanks 42 and the flat face 44 can vary between 20° and 45°. FIG. 6 illustrates a further modification of the blade which has a diamond shape. In this embodiment both opposite faces 42 and 44 have been modified to apply a diamond shape to the blade 16. Note that shapes are given for the illustrative purposes only, other shapes of the blades such as an oval one can be used as well.

In accordance with another aspect of the invention, the blade 16 can be applied different cross-sections along its length. Thus, as diagrammatically shown in FIG. 3, the blade can have a segment 48 provided with a triangular cross-section, and another segment 50 formed with the diamond shape. Further it possible to provide the blade with an oval cross section taken along an axis of rotation. As a result of all of the above disclosed shape modifications, the blade distributes the deflected flow over a broader angle to minimize the wear on the inside of the peripheral wall of the pipe.

Referring to FIGS. 7–11, another embodiment of a damper assembly 60 is shown, which has three blades 62, 64 and 66 pivotal relative to one another along a pivot axis which extends perpendicular to a rotation axis 70. The basic structure of the damper assembly is similar to the one shown in FIGS. 1–6 and has a cap 72 with a lever 74 attached to an end 73 of a rod 78, which is immovably attached to the central blade 62, a sleeve 80 and a nipple 76. The blades 64 and 66 are pivotally mounted to the stationary blade 62 by means of a pivot 82 which has a pair end flanges 84 preventing the pivot from sliding out of the engagement with the blades.

Figure 7:
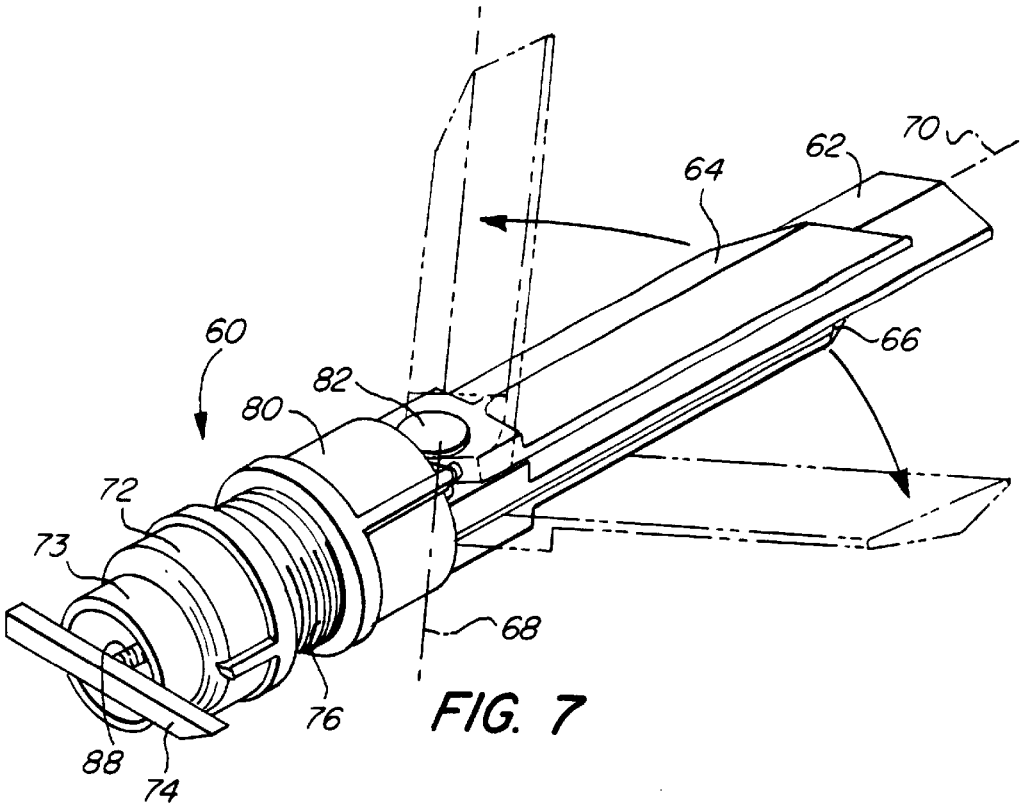
FIG. 7 is a perspective view of the damper assembly in accordance with another embodiment of the invention.
Figure 8:
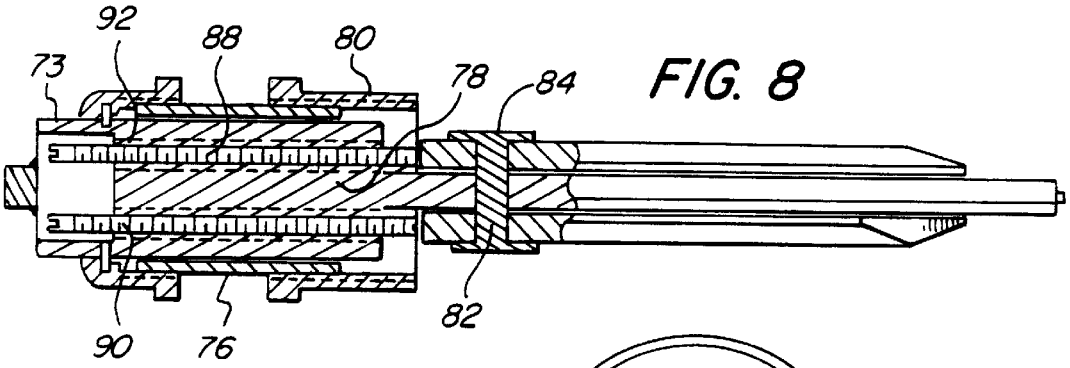
FIG. 8 is a side elevation cross-sectional view of the damper assembly shown in FIG. 7
Figure 9:
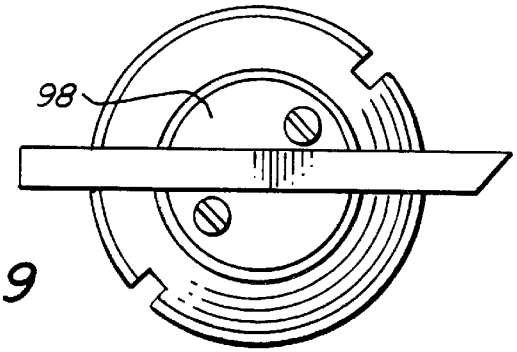
FIG. 9 is an end view of the damper assembly shown FIG. 7.
Figure 10:
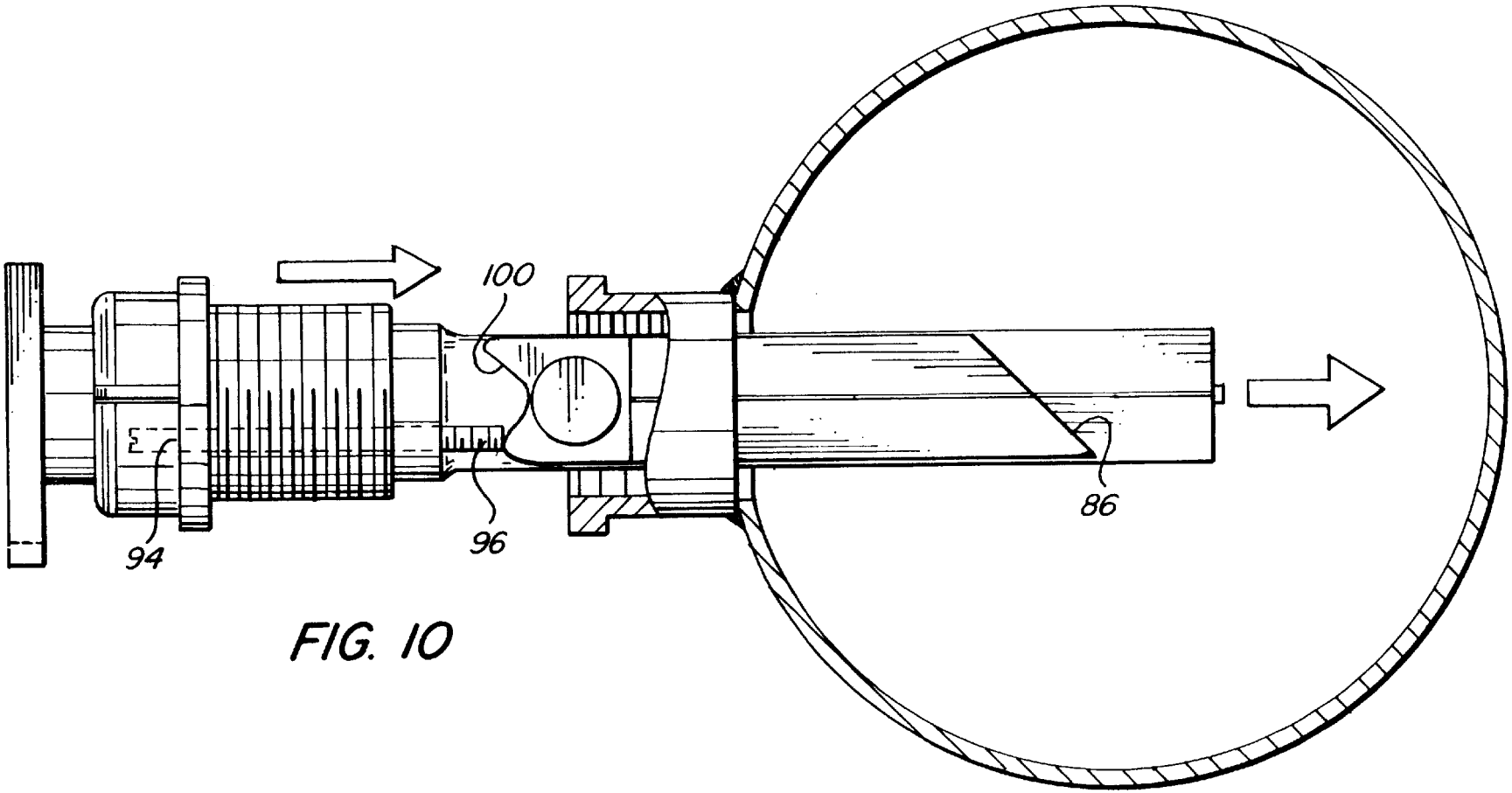
FIG. 10 is a top view of the damper assembly of FIG. 7 shown in its initial insertion position with a partially cut back portion.

Each of the blades can have a variety of the shapes as described above in reference to the FIGS. 1–6 thus providing a variety of combinations of the shapes of the, three blades. For example, as shown in FIG. 7, pivotal blades 66 and 64 can have triangular shapes, whereas the stationary blade 62 can have either a diamond shape or a triangular shape. The pivotal blades are in general somewhat shorter than the stationary blade and have distal ends 86 beveled as shown in FIG. 10. Such structure improves the blade's resistance to wear.

The pivotal blades can be angularly displaced by means of actuators 88, 90 selected from the group consisting of pins, screw and jackscrews. Each of the actuators extends through an axial channel 92 formed in the rod and has a pair of proximal and distal ends 94, 96, respectively (FIG. 10). The distal end 96 faces the respective blade and upon applying an external force to the proximal end 94, which extends in a channel 98 of the hollow cap 72, slidably engages the blade so as to enable it to move from an initial position shown in solid lines in FIG. 7 to an angular position shown in FIG. 11 and in phantom lines in FIG. 7.

Figure 11:
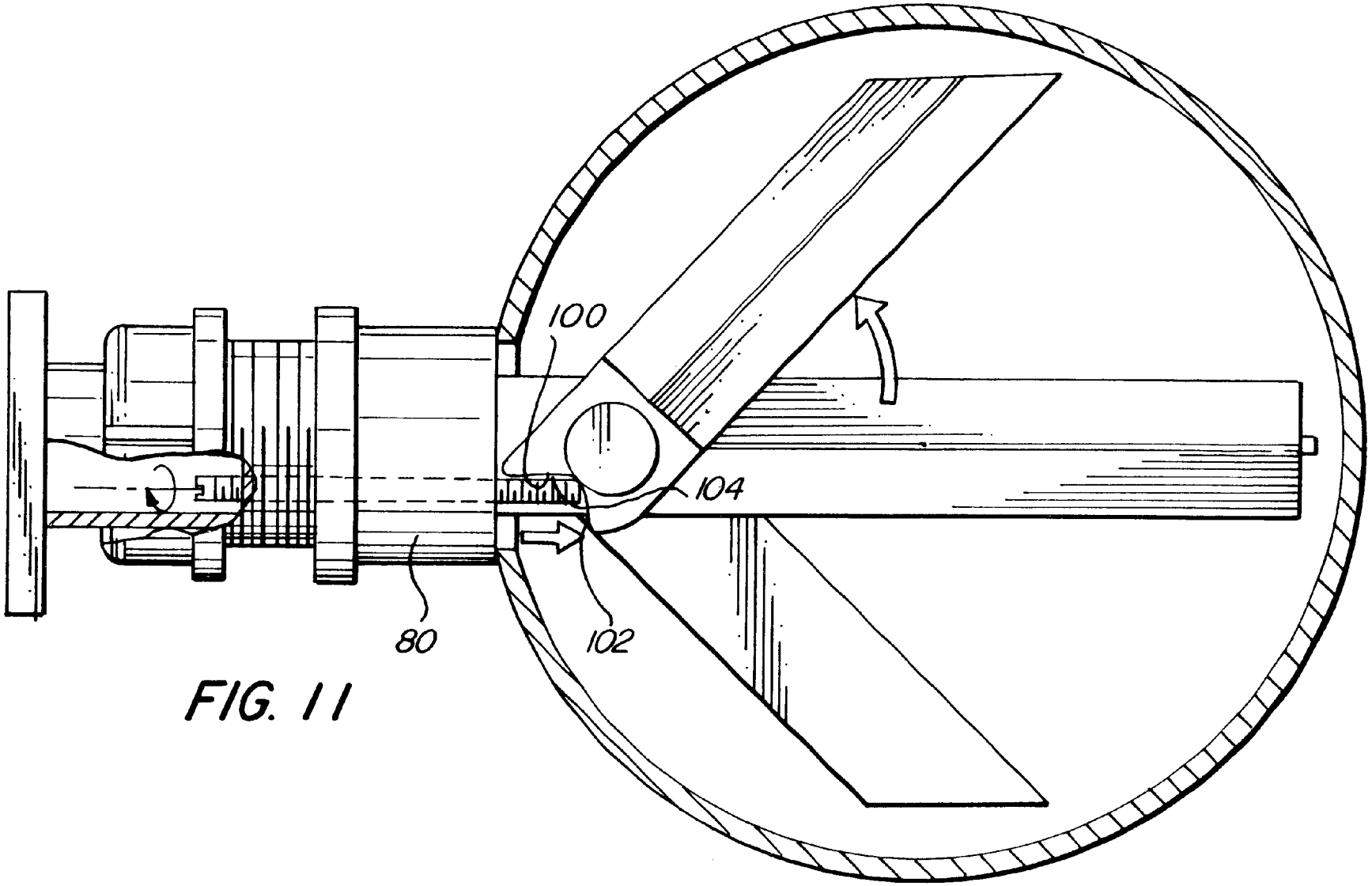
FIG. 11 is a top view of the damper assembly of FIG. 7 shown in one of its operative positions.

In accordance with one aspect of this embodiment shown in FIGS. 10 and 11, the distal ends of the actuators engage a slanted surface 102 of a V-shaped recess 100 and translate a linear motion of the actuator into the angular displacement of the blade. In order to displace the blades back in their initial position, as shown in FIG. 7 the whole assembly can be pulled back so that the mounting sleeve 80 will automatically the blades place in the initial position upon withdrawing of the actuator. Still another modification includes another actuator which is capable of engaging a surface 104 the V-shaped recess and urging against it to displace the blade in an opposite direction after the first actuator has been withdrawn.

Figure 12:
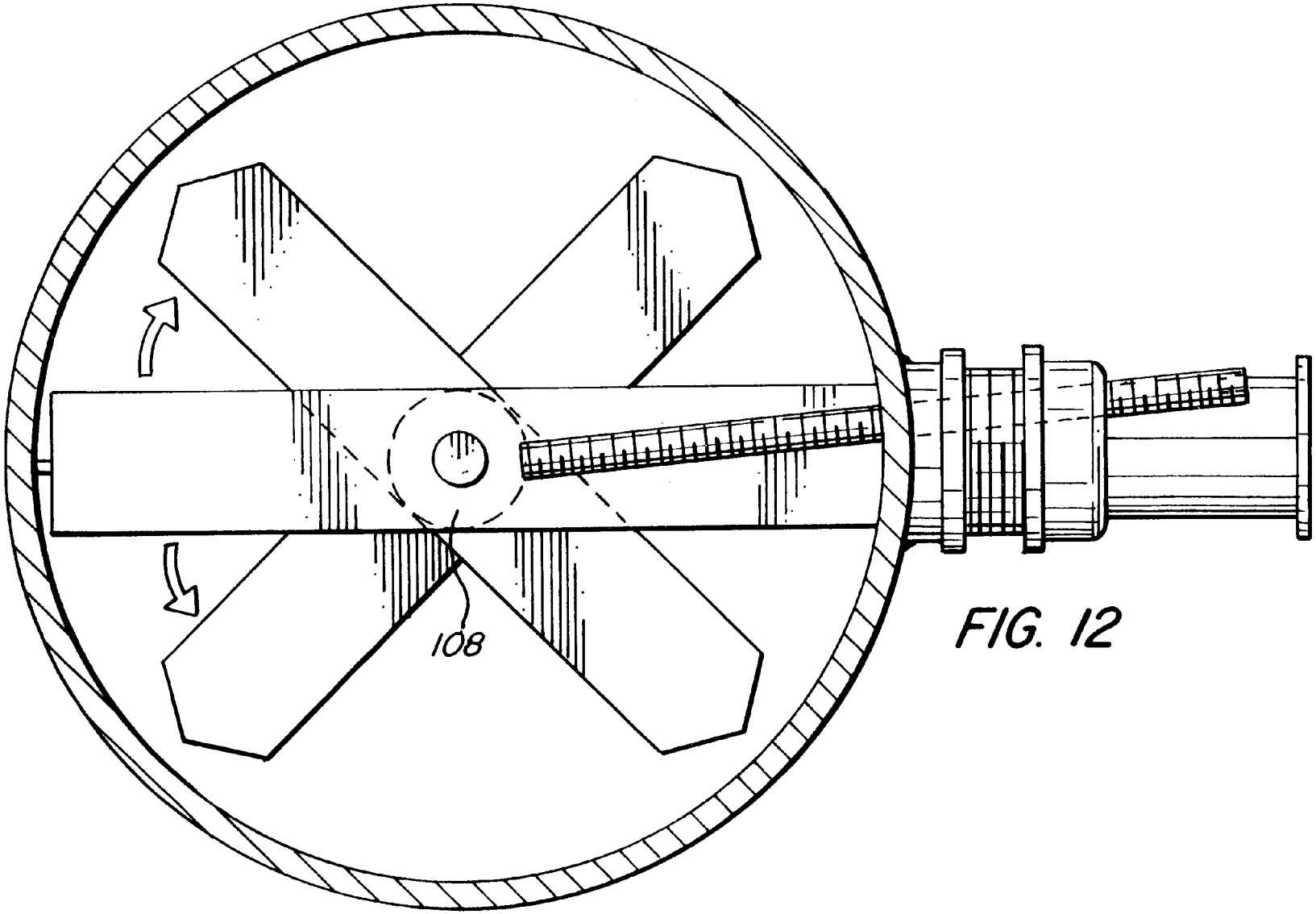
FIG. 12 is a top view of the damper assembly in accordance with still another embodiment of the present invention.

In accordance with still another aspect of the second embodiment, as shown in FIG. 12, it is possible to extend the actuator to a central region of the blades, which are centrally interconnected by a pivot 108, in order to angularly displace the blades relative to one another.

Although the invention has been described with reference to a particular arrangements of parts, features and the like, these are not intended to exhaust all possible arrangements or features, and indeed many other modifications and variations will be ascertainable to those of skill in the art.

What is claimed is:

1. A method of installing a damper assembly for adjusting a flow of coal comprising the steps of:

providing an opening in a peripheral wall of a conduit, the opening being sized to have its inner periphery slightly greater than an outer dimension of a flow controlling blade;

attaching a mounting sleeve to the conduit such that the mounting sleeve surrounds the opening;

attaching a nipple to the mounting sleeve;

inserting an elongated flow controlling blade through the opening and into the conduit;

traversing the conduit with the elongated flow controlling blade and the blade's longitudinal axis; and controllably rotating the nipple about a rotation axis relative to the mounting sleeve to rotatably displace the flow controlling blade for variably blocking the flow.

2. A damper assembly for adjusting a flow of coal, comprising:

a conduit having an opening and having a peripheral wall;

an elongated flow controlling blade inserted through said opening and across the coal flow rotatably mounted to said conduit, said blade having a thickness selected to present a minimal blocking of the flow of coal and a width selected that is substantially less than a cross sectional dimension of said conduit while blocking a substantial portion of the flow through said conduit when said blade is rotated to present the width against the flow, whereby said opening into said conduit can be minimized while enabling sufficient control over the flow through said conduit with a rotation of said blade to variably block the flow.

3. The damper assembly defined in claim 2 wherein the blade has opposite upstream and downstream faces, at least one of said opposite faces being flat.

4. The damper assembly defined in claim 3 wherein both upstream and downstream opposite faces of the blade are flat.

5. The damper assembly defined in claim 2 wherein the blade has opposite upstream and downstream faces, which extend transversely to the flow path, and having a plane of symmetry, at least one of the opposite faces having two flanks converging toward one another at a distance from the plane of symmetry to provide the one face with a generally triangular cross-section.

6. The damper assembly defined in claim 5 wherein each of the flanks extends at angle varying from 20° to 45° with respect to the plane of symmetry.

7. The damper assembly defined in claim 5 wherein the other one of the opposite faces has a generally triangular cross-section substantially identical to the cross-section of the one face, so that the blade has a diamond shape.

8. The damper assembly defined in claim 2 wherein the flow controlling blade has opposite proximal and distal ends, the damper assembly further comprising a rod extending through the peripheral wall of the one conduit from the proximal end of the flow controlling blade and having a diameter substantially equal to the width of the flow controlling blade, the flow controlling blade having varying cross sections to distribute the deflected flow over a broader angle to minimize the wear of an inner surface of the peripheral wall of the one conduit.

9. The damper assembly defined in claim 8 wherein the rod has a nipple mounted on and extending along a portion of the rod, the damper assembly further comprising a cap detachably mounted on a proximal end of the nipple and a mounting sleeve.

10. The damper assembly defined in claim 7 wherein the nipple has an outer thread mating with an inner thread of the mounting flange to allow the damper assembly to rotate upon applying an external torque to the cap.

11. The damper assembly defined in claim 2 further comprising an actuator controllably rotating the damper assembly.

12. The damper assembly of claim 2, wherein the conduit has an opening receiving the flow controlling blade and wherein the opening has a dimension sized slightly larger than an outermost dimension of the flow controlling blade.

13. The damper assembly of claim 2, wherein said flow controlling blade has upstream and downstream opposite faces, at least one of the opposite faces is provided with a pair of flanks converging toward one another, wherein at least one flank and the other face define an angle approximately between 5° and 40°.

14. The damper assembly of claim 2, including:

a rod attached to said flow controlling blade for simultaneous rotation therewith and extending through an opening of the conduit, a nipple attached to a portion of the rod, the nipple having a proximal end;

a mounting sleeve attached to the conduit and surrounding the opening; and a friction element between the mounting sleeve and the nipple allowing relative rotation motion there between upon applying an external torque to the proximal end of the nipple.

15. The damper defined in claim 9, wherein the nipple has a smooth outer surface, whereas the mounting flange and the cap are provided with a smooth inner surfaces, the damper further comprising a plurality of compression rings between the outer surface of the nipple and inner surfaces of the cap and mounting flange.

* * * * *